United States Patent [19]

Trimborn

[11] Patent Number: 4,756,672

[45] Date of Patent: Jul. 12, 1988

[54] LIQUID-RING PUMP WITH MAINTENANCE OF LIQUID LEVEL

[75] Inventor: Peter Trimborn, Nuremberg, Fed. Rep. of Germany

[73] Assignee: Siemens Aktiengesellschaft, Berlin & Munich, Fed. Rep. of Germany

[21] Appl. No.: 938,503

[22] Filed: Dec. 5, 1986

[30] Foreign Application Priority Data

Jan. 27, 1986 [DE] Fed. Rep. of Germany ..... 3602339

[51] Int. Cl.[4] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,310,584 | 7/1919 | Smith | 417/68 |
| 1,662,250 | 3/1928 | Jennings | 417/68 X |
| 2,195,174 | 3/1940 | Jennings | 417/68 |
| 2,230,405 | 2/1941 | Jennings | 417/68 X |
| 3,032,258 | 5/1962 | Jennings | 417/68 |
| 3,043,498 | 7/1962 | Gabbioneta | 417/68 |
| 3,721,508 | 3/1973 | Mugele | 417/68 |
| 4,545,730 | 10/1985 | Lübke | 417/68 |

FOREIGN PATENT DOCUMENTS

| | | | |
|---|---|---|---|
| 3425616 | 1/1986 | Fed. Rep. of Germany | 417/68 |
| 416901 | 12/1946 | Italy | 417/68 |

*Primary Examiner*—Carlton R. Croyle
*Assistant Examiner*—Paul F. Neils
*Attorney, Agent, or Firm*—Kenyon & Kenyon

[57] ABSTRACT

In an inlet region or chamber of an end bell of a liquid-ring pump, an injection nozzle is provided for replenishing the liquid in the rotating ring of the machine.The injection nozzle is arranged in the vicinity of a suction slot provided in a control disc of the liquid-ring pump. The injection nozzle is disposed above a minimum liquid level extend when only gas is being transported by the pump and below a maximum liquid level extant when a mixture of both gas and working liquid is being pumped.

4 Claims, 2 Drawing Sheets

LIQUID-RING PUMP WITH MAINTENANCE OF LIQUID LEVEL

BACKGROUND OF THE INVENTION

This invention relates to a liquid-ring pump for transporting a medium of changing amounts of liquid and gas. More particularly, this invention relates to such a liquid-ring pump provided with a mechanism for replenishing working liquid in the liquid ring during pump operation.

A liquid-ring pump comprises a housing including a pair of end bells, at least one of the end bells being provided with an inlet and an outlet for a gas to be pumped. A vane wheel is disposed in the housing between the end bells, the vane wheel being rotatably and eccentrically supported by the end bells for forming a liquid ring in the housing during operation of the pump. Upon formation, the liquid ring is disposed circumferentially with respect to the vane wheel. At least one control disc is provided in the housing between the one of the end bells and the vane wheel, the disc being formed with a suction slot associated with the inlet of the end bell and a pressure slot associated with the outlet.

Such a liquid-ring pump is provided with an arrangement of injection nozzles in the inlet region between the control disc and the juxtaposed end bell. The injection nozzles feed a predetermined amount of working liquid to the inlet region of the pump independently of the liquid level in the end bell. The rate at which the new working liquid is conveyed to the end bell is determined in accordance with expected transport of the working liquid from the pump with the gas being pumped, the rate or amount of added working liquid being selected to maintain a constant amount of liquid in the rotating ring. If only gas is transported by the pump, the constant addition of working liquid results in an increase in the liquid in the rotating ring, which increase causes a higher load on the liquid-ring machine.

An object of the present invention is to provide an improved liquid-ring pump of the above-described type.

Another, more particular, object of the present invention is to provide such an improved pump wherein the amount of liquid in the rotating ring is maintained at a substantially constant level.

Another particular object of the present invention is to provide such a pump wherein the working liquid supplied to the pump through the injection nozzles at a given pressure is automatically throttled from a maximum amount required when a mixture of gas and working liquid is transported to a smaller amount when only gas is transported by the pump.

Another object of the present invention is to provide such a pump in which the load on the pump is essentially constant.

Yet another particular object of the present invention is to provide such a pump in which working liquid is saved with increasing amount of liquid transported with the gas by the pump.

A further object of the present invention is to provide such a pump in which the amount of working liquid added to the supply in an end bell can be throttled practically down to zero.

SUMMARY OF THE INVENTION

A liquid-ring pump for transporting a medium of changing amounts of liquid and gas comprises a housing body, a pair of end bells attached to the housing body, a vane wheel disposed in the housing body and between the end bells and a control disc also disposed in the housing body between the end bells. At least one of the end bells is provided with an inlet and an outlet for a gas to be pumped, while the vane wheel is rotatably and eccentrically supported by the end bells for forming a liquid ring during operation of the pump. The control disc is formed with a suction slot associated with the inlet and a pressure slot associated with the outlet.

In accordance with the present invention, the liquid-ring pump is provided with a liquid maintenance device for replenishing liquid in the liquid ring during operation of the pump. The liquid is replenished at a rate which varies in accordance with (i.e., proportionately to) the rate that liquid is conveyed through the outlet of the pump with the gas. This control of the replenishing of liquid is achieved by including at least one injection nozzle in one of the end bells in an inlet region thereof, the injection nozzle being disposed proximately to the suction slot above a minimum liquid level extant when only gas is transported by the pump and below a maximum liquid level extant when a mixture of liquid and gas is pumped. The liquid escaping from the injection nozzle during an open condition thereof forms a liquid curtain over the suction slot to be penetrated by the gas to be pumped.

In an liquid ring pump in accordance with the present invention, the working liquid added to the pump is automatically throttled in order to achieve a substantially constant amount of liquid in the rotating ring. This cuts down on the waste of working liquid and ensures that the pump operates at a substantially constant load. If moist air is to be suctioned off, an increase condensation affect also results.

DETAILED DESCRIPTION

Figure 1:
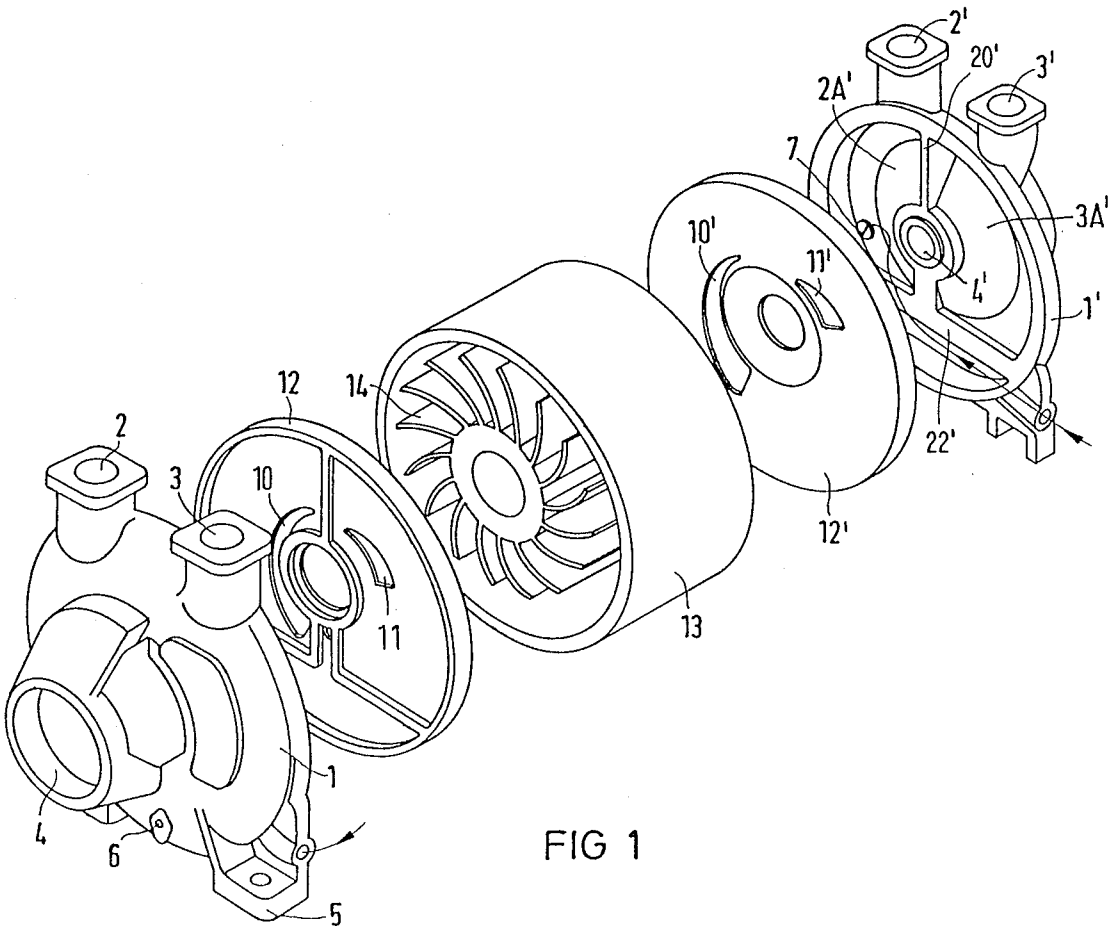
FIG. 1 is a partially schematic exploded perspective view of a liquid-ring pump with two control discs and a pair of opposed end bells.

As illustrated in FIG. 1, a liquid-ring pump comprises a pair of end bells 1 and 1′ attached to opposite sides of a cylindrical housing body 13. Each end bell 1 and 1′ is provided with a respective gas inlet 2 or 2′ and a respective gas outlet 3 or 3′. Each end bell 1 and 1′ is further provided on an inner side with a plurality of partitions, exemplarily partitions 20′ and 22′ in end bell 1′, sectioning the inner side of the respective end bell into an inlet region 2A or 2A′ and an outlet region 3A or 3A′.

Between end bell 1 and housing body 13 is provided a control disc 12 having a suction slot 10 and a pressure slot 11 communicating with the inlet region 2A (FIG. 2) and the outlet region 3A, respectively, of end bell 1. Similarly, another control disc 12′ is clamped between end bell 1′ and housing body 13. Control disc 12′ is provided with a suction slot 10′ communicating with inlet region 2A′ and a pressure slot 11′ communicating with outlet region 3A′.

A vane wheel 14 is rotatably and eccentrically mounted in housing body 13 on a shaft (not illustrated)

journaled in an opening 4 of end bell 1 and a corresponding opening 4' in end bell 1'.

Figure 2:
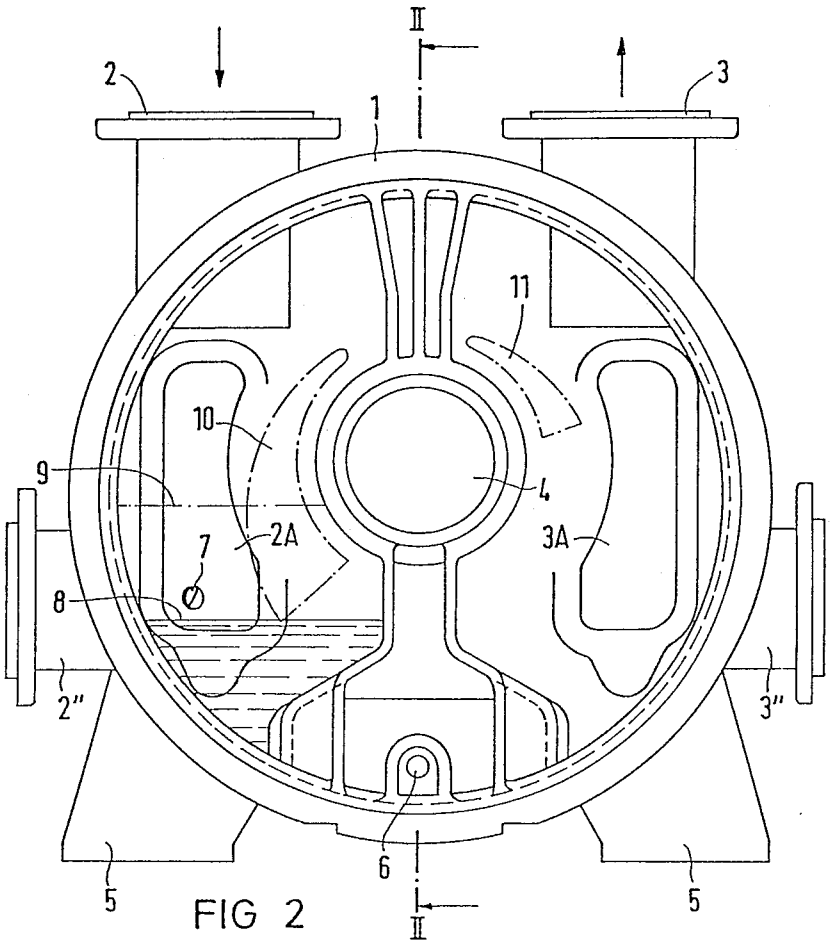
FIG. 2 is a front elevational view of one of the end bells of FIG. 1.
Figure 3:
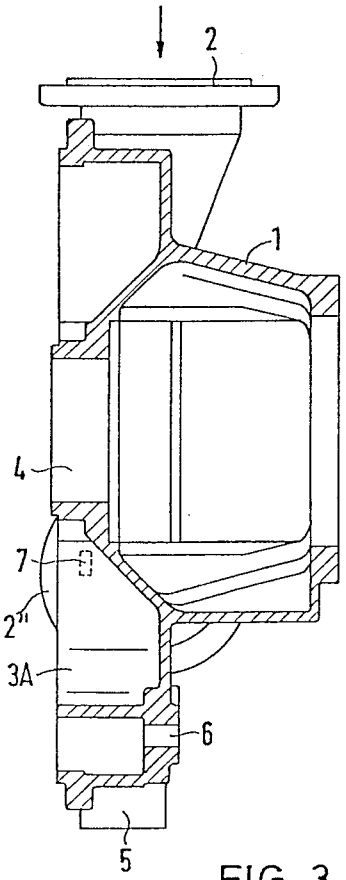
FIG. 3 is a longitudinal cross-sectional view taken along line II—II in FIG. 2.

As illustrated in FIGS. 1 and 2, end bell 1 (as well as end bell 1') is provided with a pair of support legs 5 and a conventional liquid return or drain 6. End bell 1 (or end bell 1') may be additionally provided, as shown in FIG. 2, with an optional inlet 2'' and an optional outlet 3''. Inlet 2'' opens into inlet region or chamber 2A in end bell 1, while outlet 3'' communicates with outlet region or chamber 3A. As indicated in FIG. 2 by dot-dash lines, suction slot 10 and pressure slot 11 communicate with inlet region 2A and outlet region 3A, respectively.

In inlet region 2A of end bell 1, an injection nozzle 7 is arranged in the vicinity of suction slot 10 above a minimum liquid level 8 extant in end bell 1 when only gas is transported by the liquid-ring pump. Injection nozzle 7 is located below a maximum liquid level 9 extant if a gas and liquid mixture is transported by the pump. Liquid can be conveyed through injection nozzle 7 without the application of pressure at the liquid source, the transporting force being provided by the suction power of the pump.

In accordance with the invention, working liquid fed to injection nozzle 7 under a definite pressure can be conveyed for purposes of cooling the machine, sealing the gaps and replenishing the liquid in the rotating ring, during a pumping of gas only, in a maximum amount in the form of a liquid curtain over suction slot 10. The amount of liquid entering inlet region 2A via injection nozzle 7 is throttled in accordance with the amount of liquid being pumped with the gas through outlet 3. Throttling can occur independently of the liquid level and enters the liquid reservoir in inlet region 2A of end bell 1 without forming a liquid curtain in the event that a mixture of liquid and gas is transported through outlet 3 of the pump.

In accordance with the present invention, an automatic mass control of the working liquid supply by a kind of liquid valve is effectuated. A change in the type of liquid supply is also achieved.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and illustrations herein are proffered by way of example to facilitate comprehension of the invention and should not be construed to limit the scope thereof.

What is claimed is:

1. A liquid-ring pump for transporting a medium of changing amounts of liquid and gas, said pump comprising:

a housing body;

a pair of end bells attached to said housing body, at least one of said end bells being provided with an inlet and an outlet for a gas to be pumped;

a vane wheel disposed in said housing body and between said end bells, said vane wheel being rotatably and eccentrically supported by said end bells for forming a liquid ring during operation of the pump, said liquid ring being disposed circumferentially with respect to said vane wheel;

a control disc in the housing body and between said one of said end bells and said vane wheel, said disc being formed with a suction slot associated with said inlet and a pressure slot associated with said outlet; and liquid maintenance means at a definite pressure for replenishing liquid in said liquid ring during operation of the pump, said liquid maintenance means including at least one injection nozzle provided in said one of said end bells in an inlet region thereof, said injection nozzle being disposed proximately to said suction slot above a minimum liquid level extant when only gas is transported by the pump and below a maximum liquid level extant when a mixture of liquid and gas is pumped, whereby liquid escaping from said injection nozzle during an open condition thereof forms a liquid curtain over said suction slot to be penetrated by the gas to be pumped.

2. The liquid-ring pump defined in claim 1 wherein said liquid maintenance means replenishes said liquid in said liquid ring at a rate varying proportionately with respect to the rate that liquid is conveyed through said outlet.

3. A liquid-ring pump for transporting a medium of changing amounts of liquid and gas, said pump comprising:

a housing body;

a pair of end bells attached to said housing body, at least one of said end bells being provided with an inlet and an outlet for a gas to be pumped;

a vane wheel disposed in said housing body and between said end bells, said vane wheel being rotatably and eccentrically supported by said end bells for forming a liquid ring during operation of the pump, said liquid ring being disposed circumferentially with respect to said vane wheel;

a control disc in the housing body and between said one of said end bells and said vane wheel, said disc being formed with a suction slot associated with said inlet and a pressure slot associated with said outlet; and liquid maintenance means for replenishing liquid in said liquid ring at a rate varying in accordance with a rate that liquid is conveyed through said outlet with the gas to be pumped, said liquid maintenance means including at least one injection nozzle provided in said one of said end bells in an inlet region thereof, said injection nozzle being disposed proximately to said suction slot above a minimum liquid level extant when only gas is transported by the pump and below a maximum liquid level extant when a mixture of liquid and gas is pumped, whereby liquid escaping from said injection nozzle during an open condition thereof forms a liquid curtain over said suction slot to be penetrated by the gas to be pumped.

4. A liquid-ring pump for transporting a medium of changing amounts of liquid and gas, said pump comprising:

a housing body;

a pair of end bells attached to said housing body, at least one of said end bells being provided with an inlet and an outlet for a gas to be pumped;

a vane wheel disposed in said housing body and between said end bells, said vane wheel being rotatably and eccentrically supported by said end bells for forming a liquid ring during operation of the pump, said liquid ring being disposed circumferentially with respect to said vane wheel;

a control disc in the housing body and between said one of said end bells and said vane wheel, said disc being formed with a suction slot associated with said inlet and a pressure slot associated with said outlet; and liquid maintenance means, including at least one injection nozzle provided in said one of said end bells in an inlet region thereof, for feeding a replenishing amount of liquid to said inlet region so that liquid escaping from said injection nozzle during an open condition thereof forms a liquid curtain over said suction slot to be penetrated by the gas to be pumped, said injection nozzle being disposed proximately to said suction slot above a minimum liquid level extant when only gas is transported by the pump and below a maximum liquid level extant when a mixture of liquid and gas is pumped.

* * * * *